US009222319B1

(12) United States Patent
Berg et al.

(10) Patent No.: US 9,222,319 B1
(45) Date of Patent: Dec. 29, 2015

(54) LCM RECOVERY TANK

(71) Applicant: BlueStone Royalty, LLC, Tulsa, OK (US)

(72) Inventors: Nathan Berg, Tulsa, OK (US); Josh Bradford, Trout, LA (US)

(73) Assignee: BlueStone Royalty, LLC, Tulsa, OK (US)

( * ) Notice: Subject to any disclaimer, the term of this patent is extended or adjusted under 35 U.S.C. 154(b) by 0 days.

(21) Appl. No.: 14/534,929

(22) Filed: Nov. 6, 2014

Related U.S. Application Data

(63) Continuation-in-part of application No. 14/296,324, filed on Jun. 4, 2014.

(60) Provisional application No. 61/830,672, filed on Jun. 4, 2013.

(51) Int. Cl.

| | |
|---|---|
| ***E21B 21/06*** | (2006.01) |
| ***E21B 27/04*** | (2006.01) |
| ***E21B 34/00*** | (2006.01) |
| ***E21B 21/015*** | (2006.01) |

(52) U.S. Cl.
CPC ..... *E21B 21/065* (2013.01); *E21B 21/015* (2013.01); *E21B 21/067* (2013.01); *E21B 27/04* (2013.01); *E21B 34/00* (2013.01)

(58) Field of Classification Search
CPC ... E21B 21/065; E21B 21/066; E21B 21/067; E21B 21/01; E21B 41/005; E21B 27/04; E21B 34/00; E21B 21/015; B01D 21/003; B01D 21/0039; B01D 21/02; B01D 21/245; B01D 21/28; B01D 33/03; B01D 36/04; B03B 5/04; B03B 5/28; B03B 7/00
See application file for complete search history.

(56) References Cited

U.S. PATENT DOCUMENTS

| | | | | |
|---|---|---|---|---|
| 3,498,393 | A * | 3/1970 | Pearce et al. | 175/48 |
| 4,216,836 | A | 8/1980 | Rayborn | |
| 4,536,286 | A * | 8/1985 | Nugent | 210/202 |
| 5,422,012 | A * | 6/1995 | Adams | 210/712 |
| 5,570,749 | A * | 11/1996 | Reed | 175/66 |
| 7,568,535 | B2 | 8/2009 | Larson et al. | |
| 7,771,594 | B2 * | 8/2010 | Ralph et al. | 210/195.1 |
| 8,132,632 | B2 | 3/2012 | Scott | |
| 8,556,083 | B2 | 10/2013 | Burnett | |
| 2005/0023038 | A1 * | 2/2005 | Seyffert | 175/65 |
| 2006/0175090 | A1 * | 8/2006 | Reitsma et al. | 175/25 |
| 2008/0121589 | A1 * | 5/2008 | Godlien | 210/738 |

(Continued)

FOREIGN PATENT DOCUMENTS

| | | |
|---|---|---|
| CA | 1134783 | 11/1982 |

*Primary Examiner* — Blake Michener
*Assistant Examiner* — Wei Wang
(74) *Attorney, Agent, or Firm* — Head, Johnson & Kachigian, P.C.

(57) ABSTRACT

An LCM recovery system that relies on gravity and density or specific gravity differences between three of the main components of drilling fluids, i.e., the mud and chemicals, lost circulation material (LCM) or additives, and drill solids or cuttings. Fluid enters the LCM recovery tank from the well via a flow line or mud gas separator return leg. Cuttings, having a greater density than additives, tend to settle and become trapped on the input side of the LCM recovery tank. The less dense fluid and entrained or suspended LCM tends to travel over the baffle near the center of the tank. LCM can then be efficiently returned to the active mud system for reconditioning or pumping downhole again.

13 Claims, 12 Drawing Sheets

(56) References Cited

U.S. PATENT DOCUMENTS

| | | | | |
|---|---|---|---|---|
| 2009/0107728 | A1 | 4/2009 | Gaddis et al. | |
| 2011/0017600 | A1 | 1/2011 | Larson | |
| 2011/0017675 | A1 | 1/2011 | Larson | |
| 2011/0114318 | A1 | 5/2011 | Ezell et al. | |
| 2013/0062261 | A1 | 3/2013 | Bailey | |
| 2014/0048331 | A1 * | 2/2014 | Boutalbi et al. | 175/38 |

* cited by examiner

LCM RECOVERY TANK

CROSS REFERENCE TO RELATED APPLICATIONS

This application is a continuation-in-part application of U.S. patent application Ser. No. 14/296,324 filed Jun. 4, 2014, which claims priority to U.S. Provisional Patent Application Ser. No. 61/830,672 filed Jun. 4, 2013 entitled "LCM RECOVERY SYSTEM," the contents of which are hereby incorporated by reference.

BACKGROUND OF THE INVENTION

1. Field of the Invention

The invention relates to a method and system for separating and recovering lost circulation material from well sites during drilling.

2. Prior Art

Drilling fluid is typically used when boreholes are drilled into the earth. For example, drilling fluid is typically used when drilling oil and natural gas wells, but it may also be used for simpler boreholes, such as water wells. Liquid drilling fluid of the sort considered herein will be referred to as "drilling mud". There are three main categories of such drilling fluids: water-based muds (dispersed and non-dispersed), and non-aqueous muds (i.e., oil-based mud, and gaseous drilling fluid), and synthetics or hybrids. Among the many benefits of using drilling fluids are that they provide hydrostatic pressure to prevent formation fluids from entering into the well bore, as well as assisting in stabilizing the wellbore. Additionally, drilling fluids cool and clean the drill bit during drilling and carry drill cuttings away from the bit to the surface. Drilling fluids additionally aid in suspending the lighter drill cuttings while drilling is paused, such as when the drilling assembly is brought in and out of the hole.

The ability of a drilling fluid to carry the rock excavated by the drill bit up to the surface depends on cutting size, shape, and density, and speed of fluid traveling up the well, i.e., it is a function of the annular velocity. The viscosity, surface tension or yield point of the drilling mud is another important consideration, since cuttings will settle to the bottom of the well if the viscosity is too low.

Lost circulation is one of the more serious problems that can arise during the drilling of an oil well or gas well. Lost circulation can be complete or partial in nature, the latter of which is usually referred to as seepage. Circulation is said to be lost when the drilling fluid, or mud, flows into the geological formations or fractures instead of returning up the annulus.

Lost circulation results in the loss of drilling fluid, which is undesirable for many reasons, including economics, wellbore stability, hole cleaning, rate of penetration, and other reasons. At times of severe seepage or lost circulation, sweeps may not sufficiently provide the relief or results desired. Additionally, loss of drilling fluids can be expensive. Hybrid water based drilling fluids, diesel based muds potassium or polymer, and even synthetic oil muds are extremely costly to lose. Lost circulation may also result in a dangerous well blowout. Therefore, well operators closely monitor tanks, pits, and flow from the well to quickly assess and control any lost circulation. If the fluid in the wellbore drops for any reason, such as lost circulation, hydrostatic pressure is reduced. The reduced hydrostatic pressure can allow a gas or fluid, which is under a higher pressure than the reduced hydrostatic pressure, to flow into the wellbore.

Another consequence of lost circulation is called "dry drilling". Dry drilling occurs when fluid is completely lost from the well bore without actual drilling coming to a stop. Dry drilling may destroy a bit or may even require a new well to be drilled. Dry drilling can also damage the drill string, whether from increased vibration or by thermal generation and thus strength degradation.

Lost circulation material (LCM) is used to control or cease lost circulation by sealing formation pores, small holes, or fractures in the wellbore. Although fine carbonates are the most common additive used, other LCM additives are employed, depending on the fluid being used and the depth of drilling in relation to desired production zones. Other LCM additives used might include, by way of example, sawdust, flaked cellophane, crushed or ground gypsum, shredded newspaper, cotton seed hulls, cedar fiber, rubbers, etc.

To avoid loss of drilling fluids and LCM, rig vibrating separators or shale shakers are often "bypassed" completely in an effort to reclaim all or some of the LCM being directly added to the active drilling system. For short intervals this method is effective and acceptable, but over time the active pits and sand traps will become completely filled with drilled cuttings causing a loss of surface pit capacity, and an increase in drill solids within the mud system. The result can be costly time consuming pit cleanings before the next hole interval or after reaching the target depth (TD) of the well, as well as reduced rate of penetration (ROP) due to an increase in drilled and low gravity solids, increased drillstring and tool wear, reduced carrying capacity of mud, or even reduced pit volumes at the surface.

As is well known in the drilling industry, there has been a need for a system and method that would provide a better way of recovering LCM material. Accordingly, it should now be recognized, as was recognized by the present inventors, that there exists, and has existed for some time, a very real need for a method of LCM recovery would address and solve the above-described problems.

Before proceeding to a description of the present invention, however, it should be noted and remembered that the description of the invention which follows, together with the accompanying drawings, should not be construed as limiting the invention to the examples (or embodiments) shown and described. This is so because those skilled in the art to which the invention pertains will be able to devise other forms of this invention within the ambit of the appended claims.

SUMMARY OF THE INVENTION

Other embodiments and variations are certainly possible within the scope of the instant invention and can readily be formulated by those of ordinary skill in the art based on the disclosure herein.

The LCM recovery system of the invention is a simple design that alleviates or reduces the impact of all or most of the issues discussed above, while maintaining a desired LCM concentration in an active mud system.

The LCM recovery system of the invention relies on gravity and large density or specific gravity differences between three of the main components of drilling fluids, i.e., the mud and chemicals, lost circulation material (LCM) or additives, and drill solids or cuttings. In one embodiment, fluid enters the LCM recovery tank directly from the well via the flow line or mud gas separator return leg. Cuttings, having a greater density than the additives, i.e., having a typical specific gravity of 2.4-2.8, will tend to settle and become trapped on the cuttings side or input side of the LCM recovery tank. The less dense fluid and entrained or suspended LCM will tend to travel over the baffle plate or plates near the center of the tank. The drilling fluid with LCM can then be efficiently returned to the active mud system for reconditioning or pumping directly downhole again.

Cuttings can be collected by mud loggers during drilling. Background gas is monitored and sampled as drilling fluid enters the LCM recovery tank. The cuttings are also typically sampled at 10' intervals. The mud loggers separate and clean the samples, e.g., by collecting a sample at the sample interval directly to the LCM tank versus what is typically done at the shale shakers.

In one embodiment, the fluid level and the tendency of the LCM and drilling fluid to travel from the input side to the recovery side of the LCM recovery tank is controlled by adjusting a height of the baffle plate or plates, e.g., by raising or lowering. The adjustability allows for varying flow rates to be managed while maintaining sufficient fluid and material recovery when used in conjunction with a wide range of hole sizes and drilling conditions observed throughout the well.

In one embodiment, an agitator provided within the cutting side or input side of the LCM recovery tank aids in pushing lighter LCM, such as carbonates and/or cedar fiber, to the recovery side across the baffle. Fluid and LCM from the recovery side are returned to the active mud system, e.g., via a centrifugal pump. The cuttings side or input side mixture of cuttings and marginal fluid volumes are returned to shale shakers for further separation.

If cuttings buildup on the cuttings side or input side becomes too great, there are two suggested options for removal. First is the use of a track-hoe, which is typically on location for dipping of the cuttings box. The track-hoe can simply remove excess cuttings during "off-pump" events such as connections, surveys, and/or rig services. Further options or embodiments to aid in the removal of cuttings from the tank include augers, fluid, jets, angled tanks, or the use of multiple suctions, which are and have been used but nonetheless are not required for successful use of the LCM recovery tank.

The foregoing has outlined in broad terms the more important features of the invention disclosed herein so that the detailed description that follows may be more clearly understood, and so that the contribution of the instant inventors to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Finally, it should be understood that the phraseology and terminology employed herein are for the purpose of description and should not be regarded as limiting, unless the specification specifically so limits the invention.

BRIEF DESCRIPTION OF THE DRAWINGS

Other objects and advantages of the invention will become apparent upon reading the following detailed description and upon reference to the drawings in which.

DETAILED DESCRIPTION OF THE PREFERRED EMBODIMENTS

Figure 1:
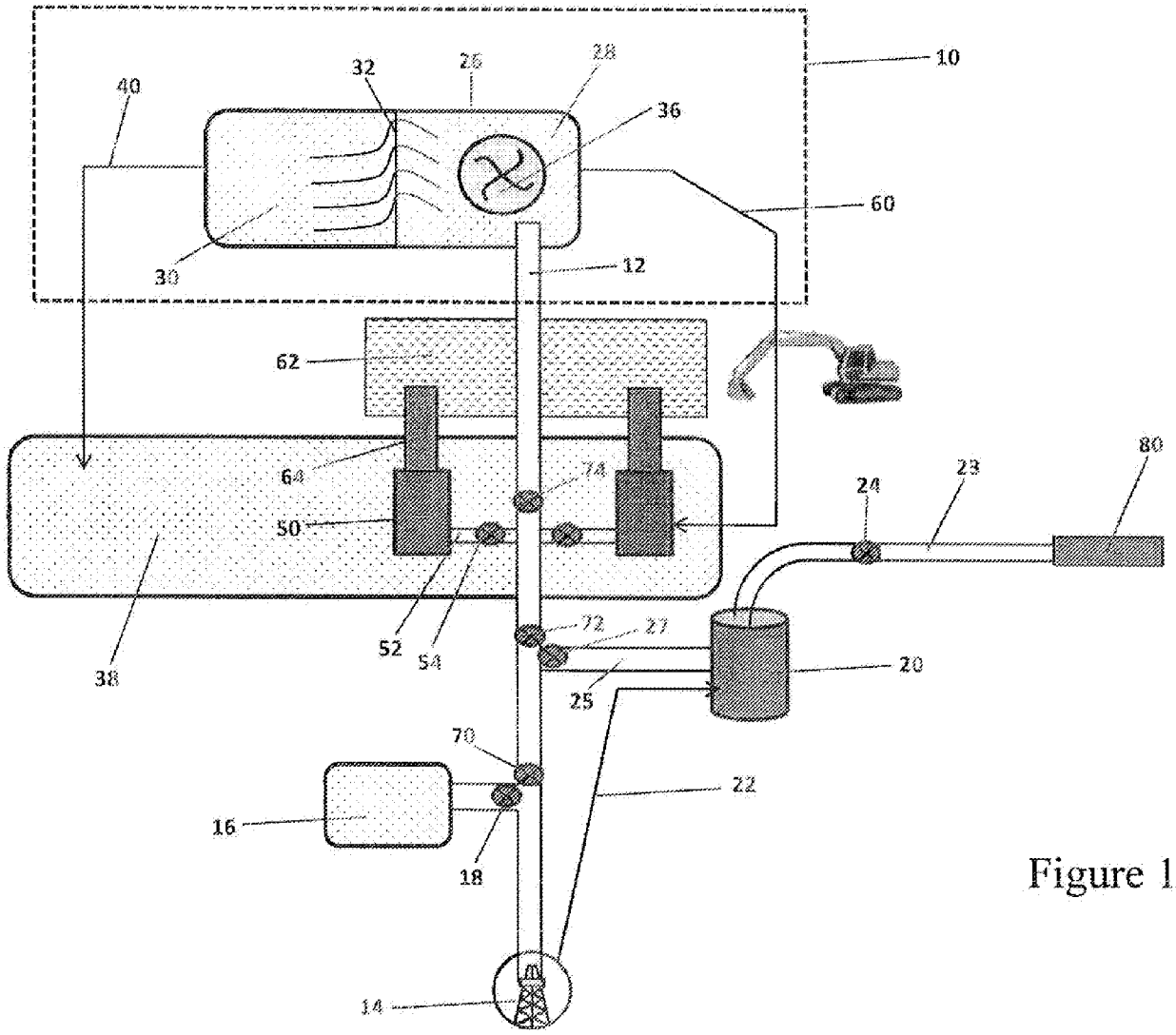
FIG. 1 is a schematic representation of the LCM recovery system of the invention in conjunction with the typical fluid handling components and pits typically found on drilling operations.

While this invention is susceptible of embodiment in many different forms, there is shown in the drawings, and will herein be described hereinafter in detail, some specific embodiments of the instant invention. It should be understood, however, that the present disclosure is to be considered an exemplification of the principles of the invention and is not intended to limit the invention to the specific embodiments or algorithms so described.

Referring to the particular embodiment of FIG. 1 in this figure the instant lost cuttings material (LCM) recovery system is designated generally as part number 10, when considering tank and lines, and part number 26 when considering just the LCM recovery tank. This variation of the LCM recovery system 10 includes flow line 12 for delivering mud cuttings and LCM material from wellbore 14 or from mud gas separator 20.

According to this embodiment, a trip tank 16 is provided in selective communication with flow line 12. A trip tank valve 18 is provided for opening or closing a pathway from the flow line 12 to the trip tank 16.

Continuing with the current example, a mud gas separator 20 may be provided. Choke line 22 extends from wellbore 14 to mud gas separator 20. Mud gas return leg 25 connects mud gas separator 20 with the flow line 12. A vent valve 27 is provided for selectively opening or closing vent line 25 from flow line 12 to mud gas separator 20. Mud gas return leg 25 and return leg valve 27 are provided to selectively deliver mud, cuttings, and LCM to flow line 12.

LCM recovery tank 26 defines an inlet chamber 28 or cuttings chamber and a recovery chamber 30 or LCM and fluid chamber.

Inlet chamber 28 receives mud, cuttings and LCM material from the flow line 12, either directly from the wellbore 14 or from mud gas separator 20 via mud gas return leg 25. In one embodiment, flow line 12 delivers mud, cuttings, and LCM material by dropping it into the open top of inlet chamber 28.

A baffle 32 or weir plate is provided for separating recovery chamber 30 and inlet chamber 28. The baffle 32 is preferably adjustable in height to account for varying flow rates through flow line 12 that may be encountered while drilling. In this embodiment, baffle 32 is oriented vertically, but it could also be sloped toward or away from the recovery chamber 30 according to the desires or needs of the designer. In a preferred embodiment, the adjustable baffle 32 is a worm driven gasket sealed gate valve. In another embodiment, baffle 32 may also be fixed rather than adjustable, and in yet another embodiment, use of multiple baffles may be employed.

In operation, a height of baffle 32 or weir plate is proportional to a flow rate of material pumped into wellbore 14. However, the most efficient height of baffle 32 may also be affected by the type and amount of LCM. Therefore, the height of baffle 32 may be determined by observation and direct recovery measurements. Sensors for determining fluid level may be provided in the LCM recovery tank 26. Examples of suitable sensors include sonic type and ball tether type.

Figure 2:
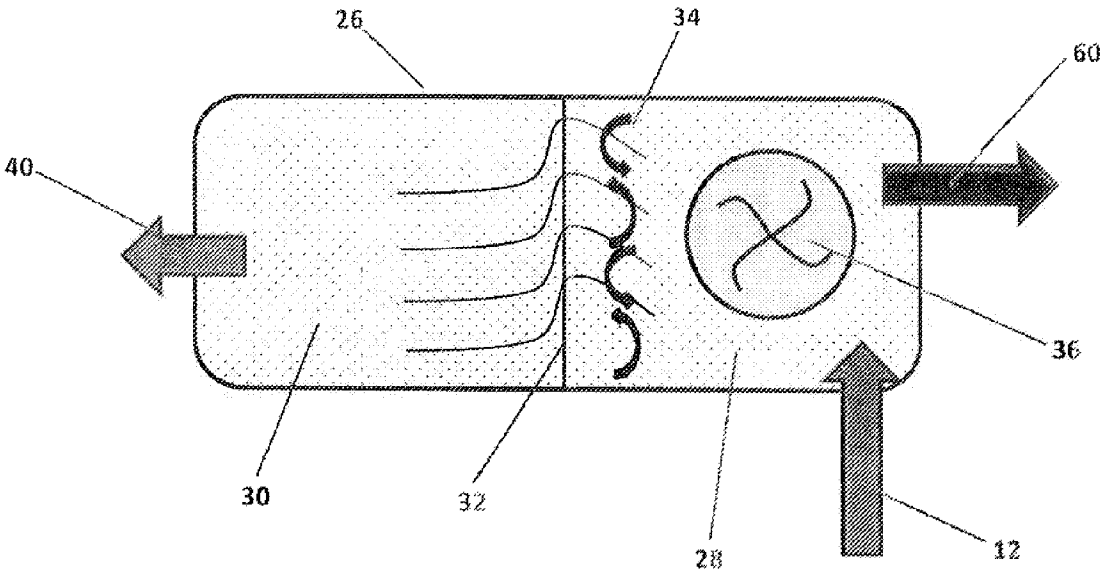
FIG. 2 is an enlarged schematic representation of the LCM recovery tank of the LCM recovery system of FIG. 1.

Optionally, a cuttings auger 34 (FIG. 2) may be provided in inlet chamber 28. Further options or embodiments to aid in the removal of cuttings from the tank include augers, fluid jets, angled tanks, or the use of multiple suctions, which are and have been used but nonetheless are not required for successful use of the LCM recovery tank. Alternatively, a track-hoe may be utilized for secondary removal during connections as noted and discussed above.

An optional agitator 36 is shown in inlet chamber 28. Agitator 36 is driven by an electric motor in some embodiments. Agitator 36 aids in pushing relatively less dense LCM material over adjustable baffle 32 as an alternative aid to collecting the LCM material in recovery chamber 30.

Figure 3:
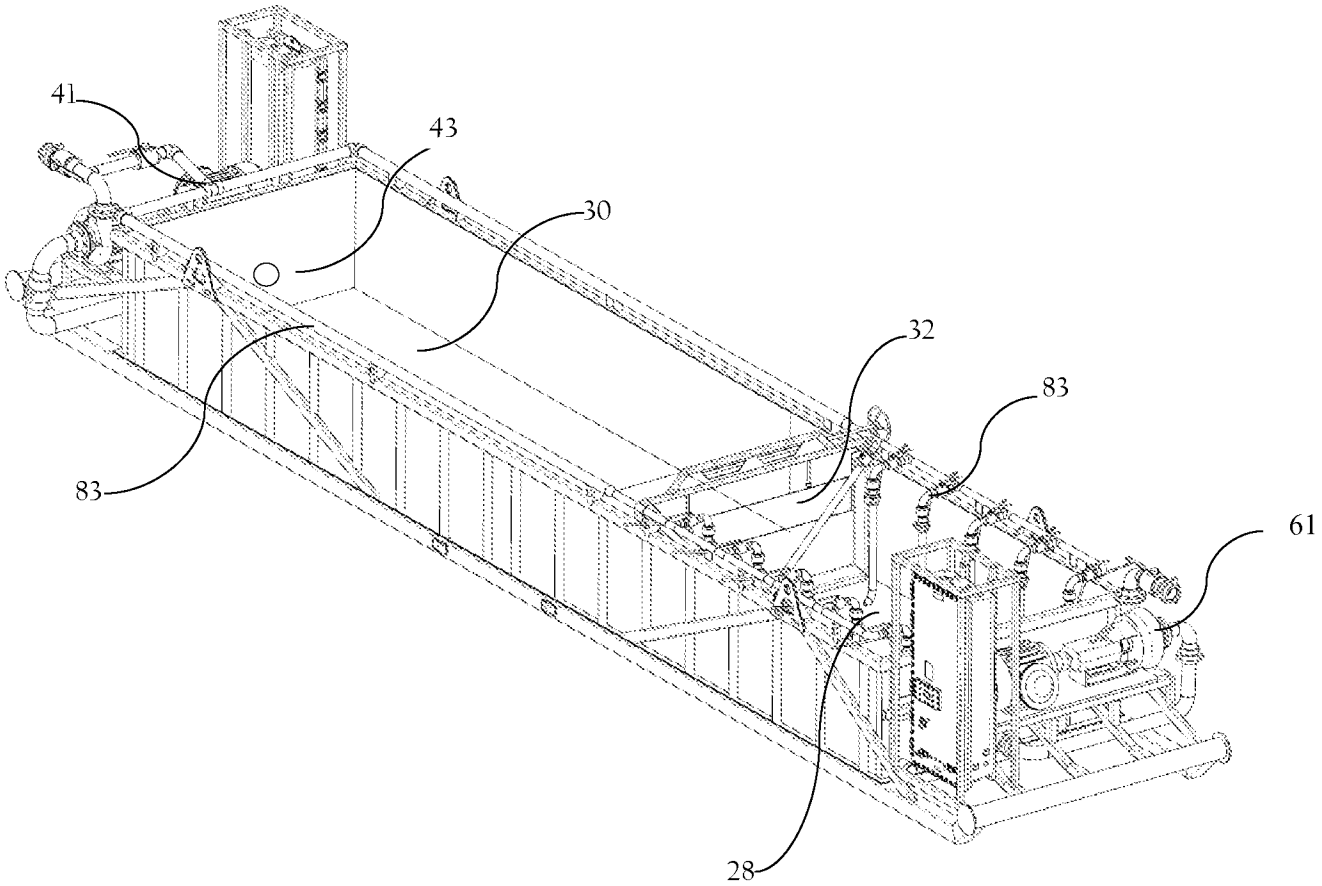
FIG. 3 is a perspective view of the LCM recovery tank of FIG. 2.
Figure 4A:
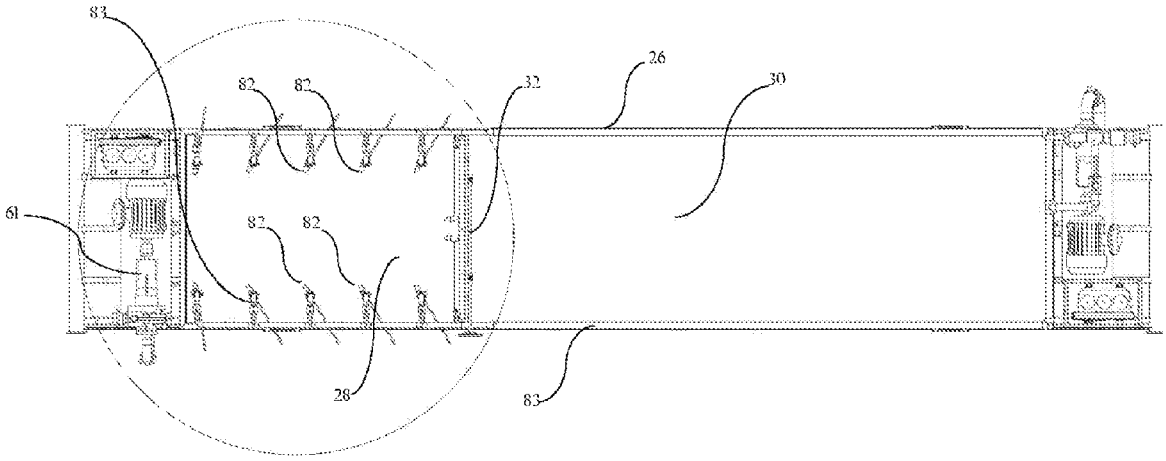
FIG. 4*a* is a partial top or overhead view of the LCM recovery tank of FIG. 2.
Figure 4B:
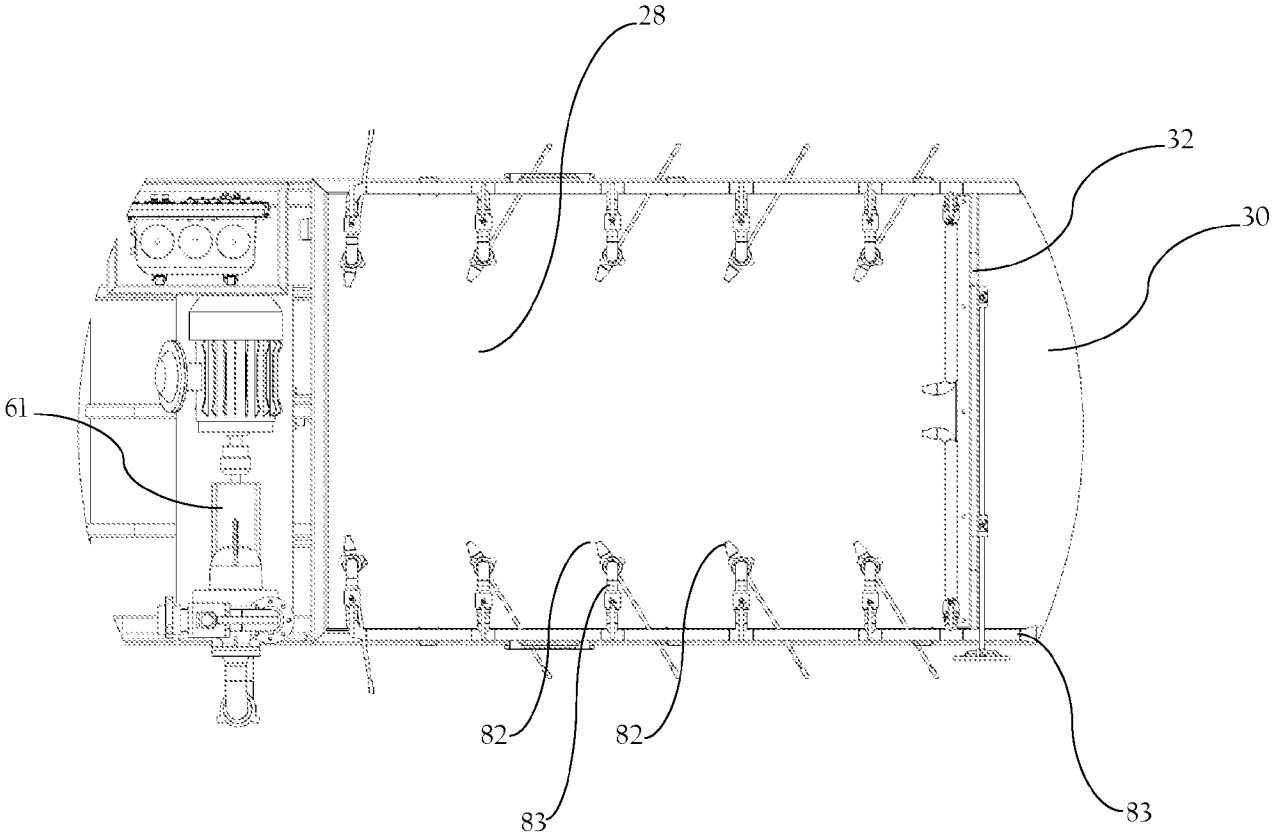
FIG. 4*b* is an enlarged view of the inlet/cuttings chamber of the LCM recovery tank of FIG. 2.
Figure 5:
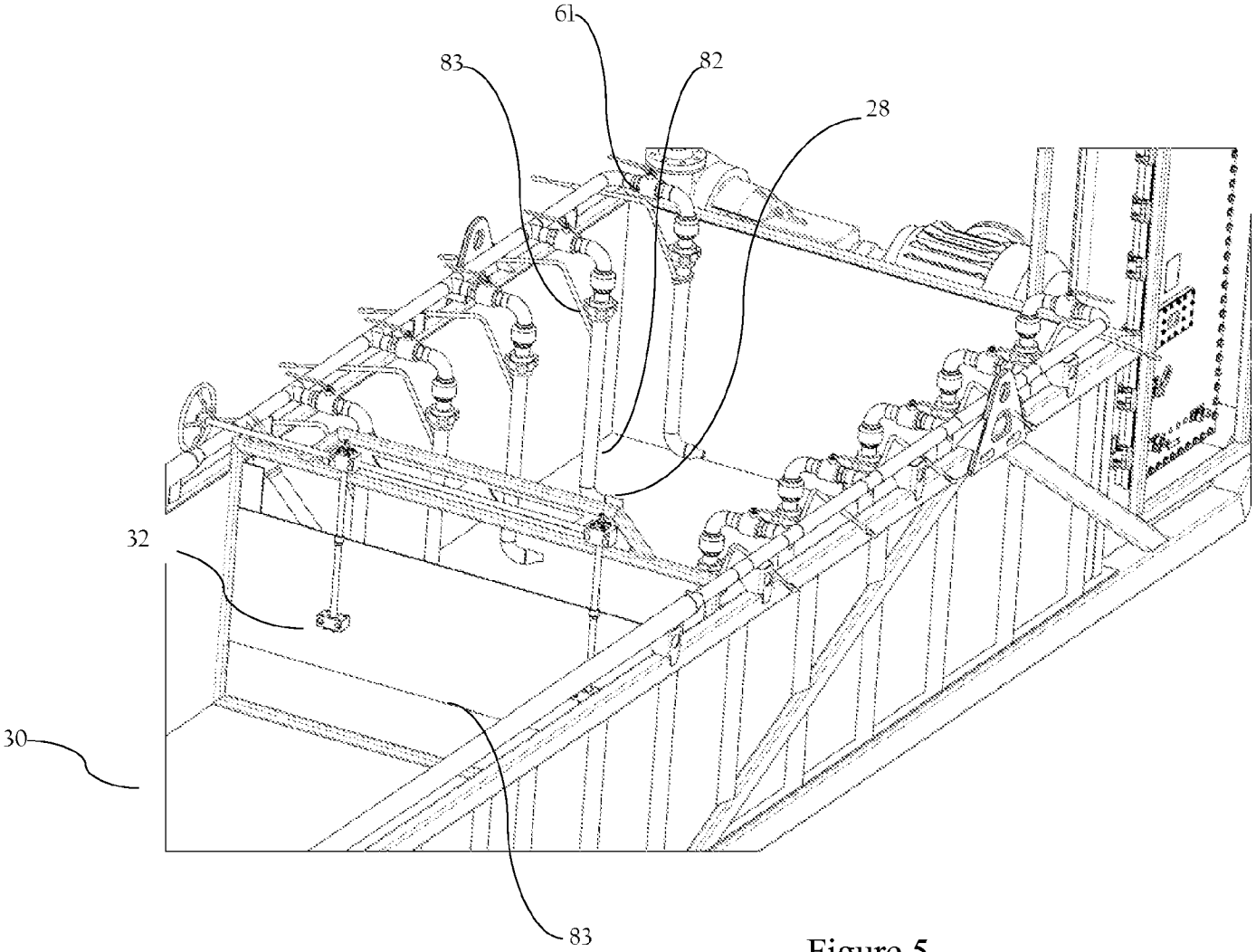
FIG. 5 is an enlarged perspective view of the baffle and inlet/cuttings chamber of the LCM recovery tank of FIG. 2.
Figure 7:
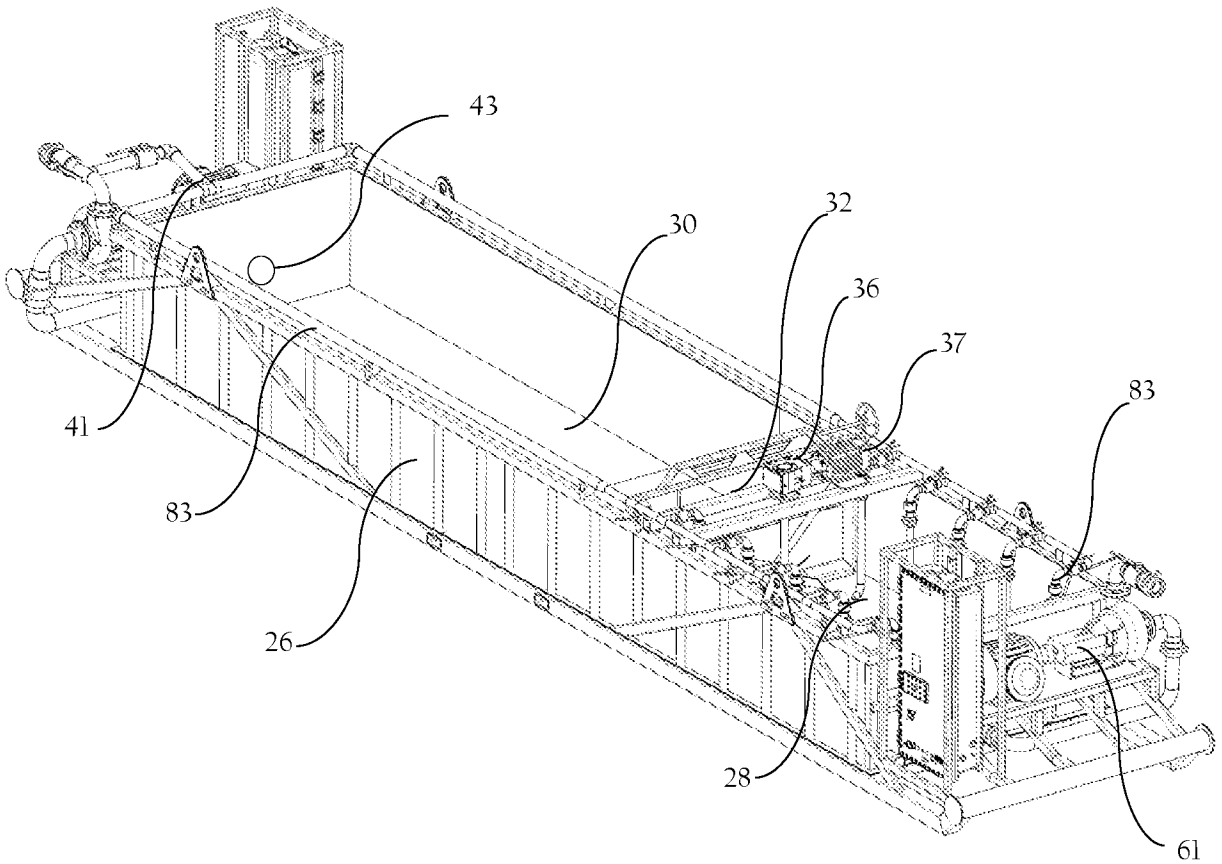
FIG. 7 is a perspective view of the LCM recovery tank of FIG. 2.
Figure 8A:
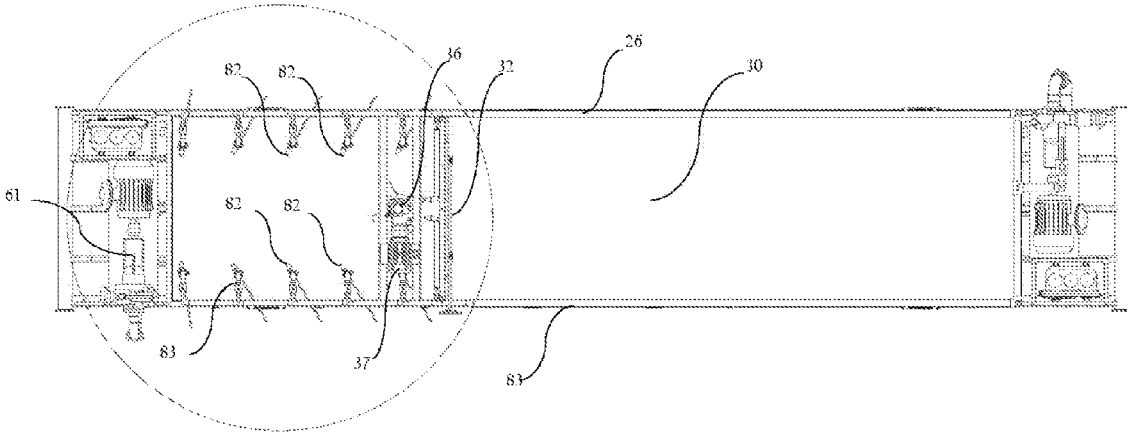
FIG. 8*a* is a partial top or overhead view of the LCM recovery tank of FIG. 2.
Figure 8B:
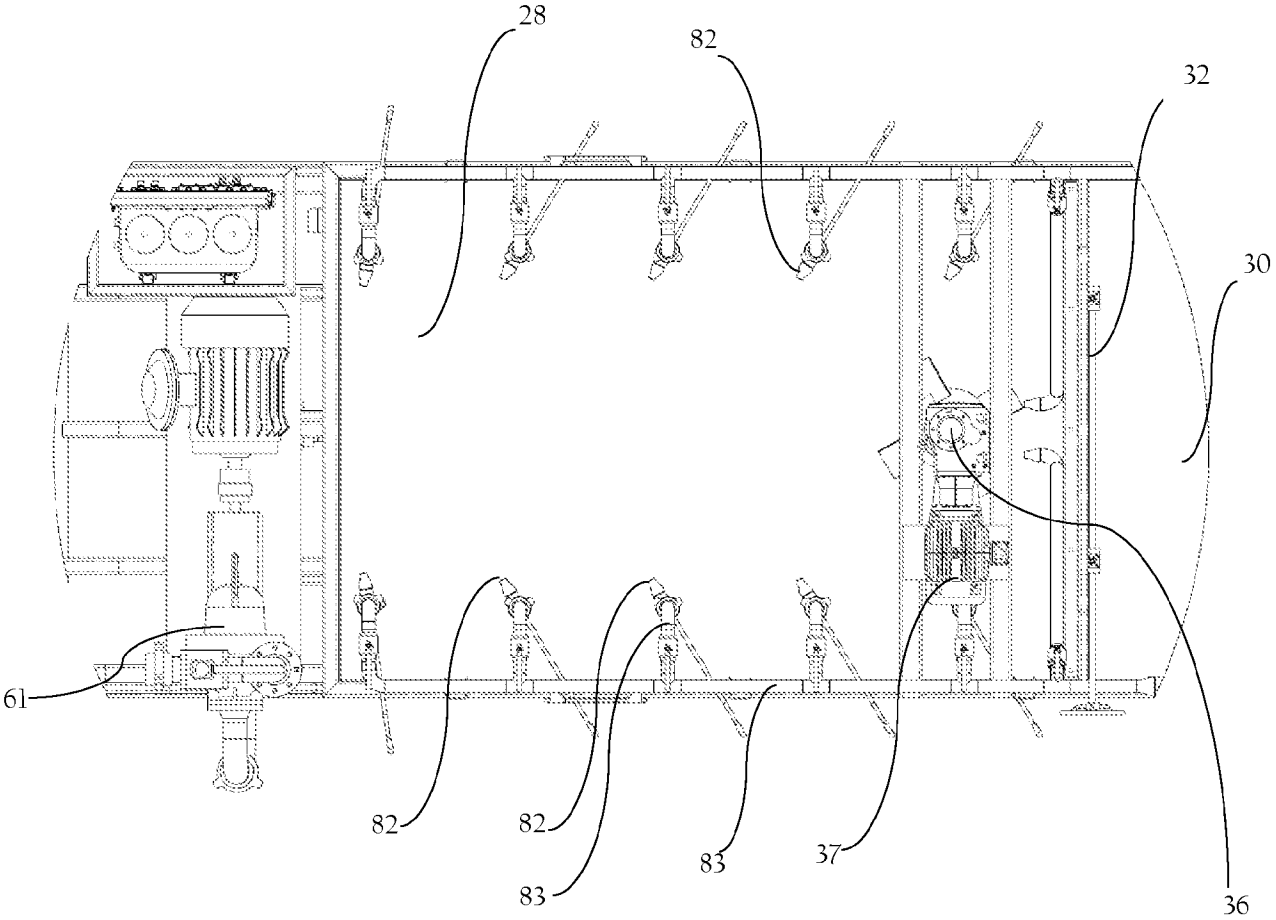
FIG. 8*b* is an enlarged view of the cuttings chamber of the LCM recovery tank of FIG. 2.

The LCM recovery system 10 of the current embodiment additionally includes an active steel mud pit 38. LCM and fluid line 40 communicates recovery chamber 30 with mud pit 38. In one embodiment, fluid side discharge pump 41 (FIGS. 3 and 7) delivers fluid into fluid line 40. Discharge pump 41 may be connected to intake pipe 43 (FIGS. 3 and 7) that extends over or through a wall of recovery tank 26.

Figure 6:
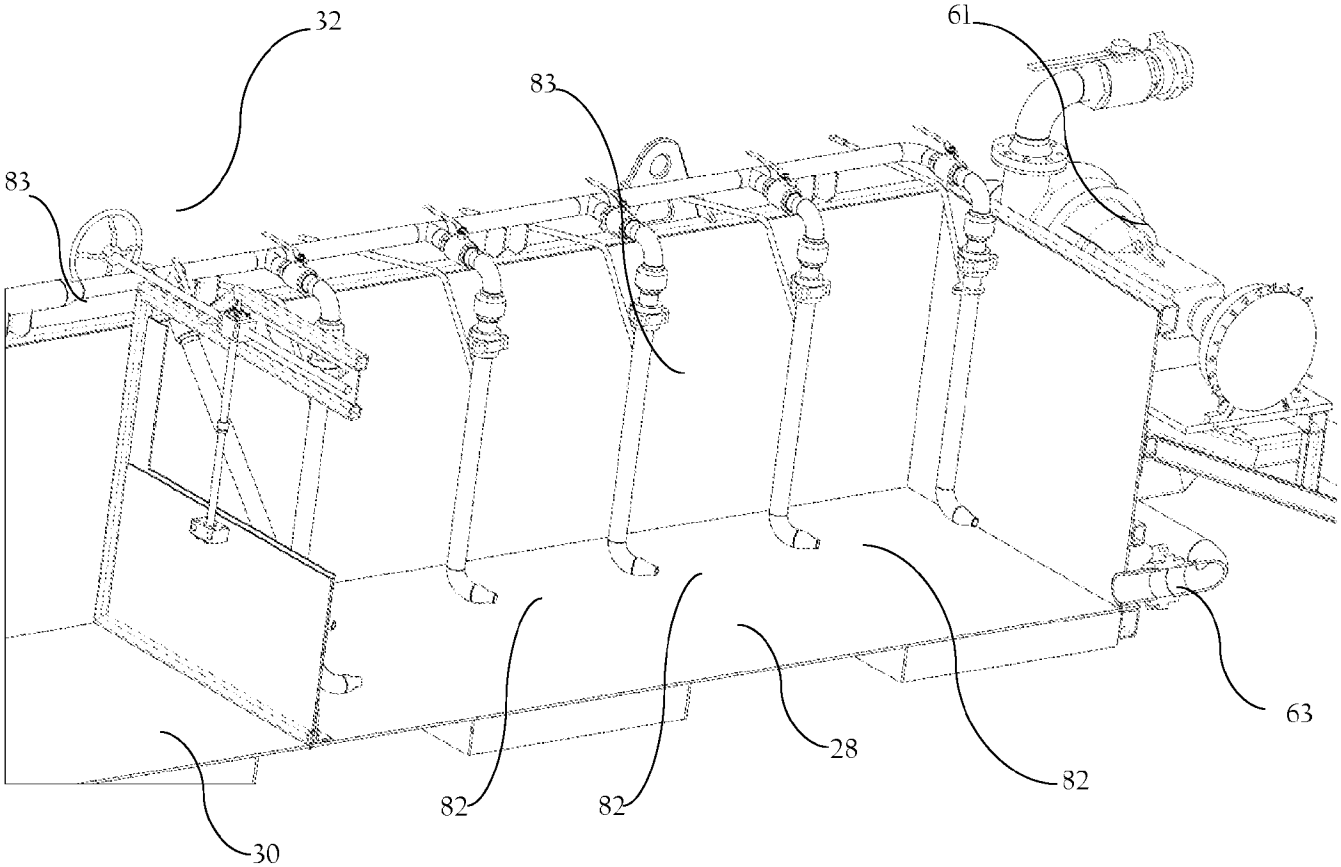
FIG. 6 is a cross-sectional perspective view of the baffle and inlet/cuttings chamber of the LCM recovery tank of FIG. 2.
Figure 9:
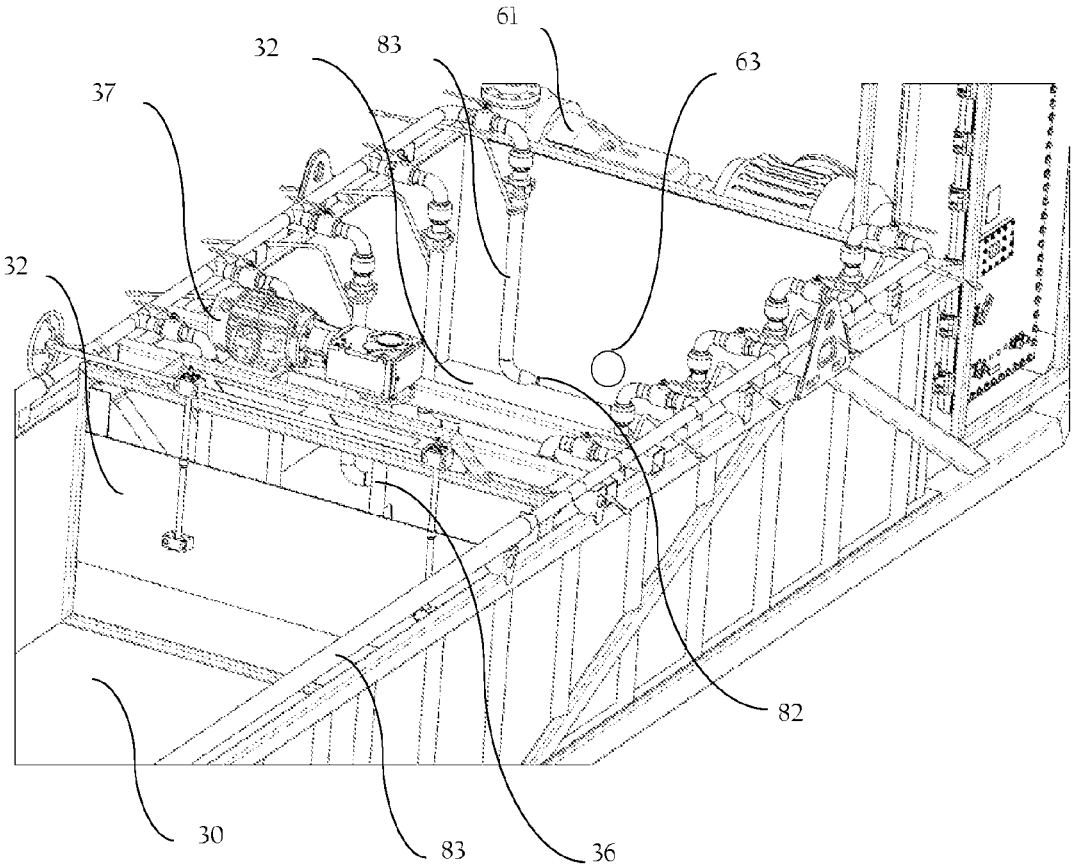
FIG. 9 is an enlarged perspective view of the baffle and inlet/cuttings chamber of the LCM recovery tank of FIG. 2.
Figure 10:
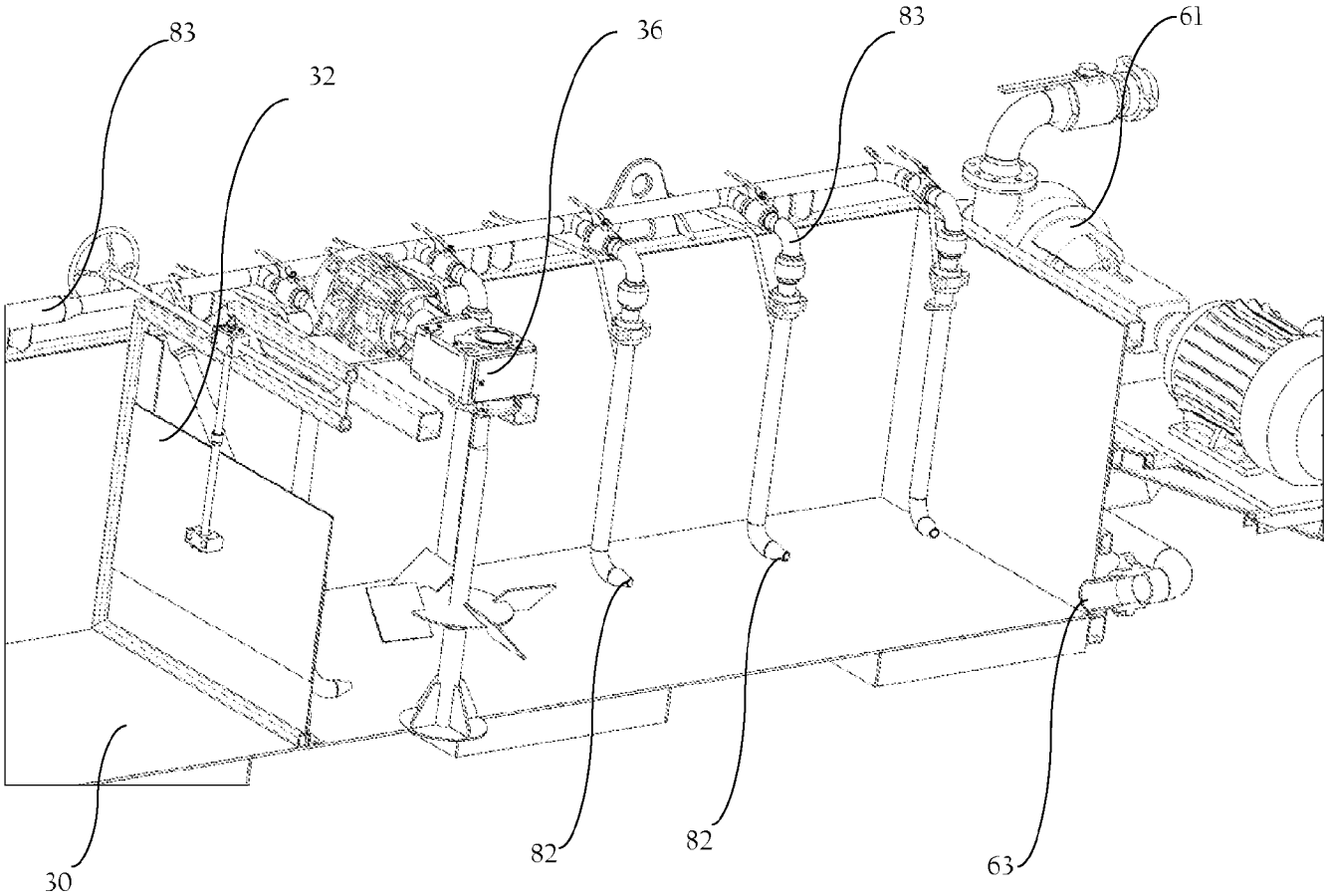
FIG. 10 is a cross-sectional perspective view of the baffle, agitators, and inlet/cuttings chamber of the LCM recovery tank of FIG. 2.

Vibrating separators or shale shakers 50 are typically positioned above mud pit 38. Shaker line(s) 52 communicates shaker 50 with flow line 12. Shaker valve(s) 54 are provided to selectively permit flow from the flow line 12 to shaker 50. Cuttings line 60 communicates inlet chamber 28 with shaker 50. Cuttings line 60 is provided to flow mud and cuttings slurry from the inlet chamber of LCM recovery tank 26 to shaker 50. In one embodiment, cuttings side discharge pump 61 (FIGS. 3-10) delivers mud and cuttings slurry into cuttings line 60. Cuttings side discharge pump 61 may be connected to an intake pipe 63 (FIGS. 6, 9, and 10) that extends over or through a wall of recovery tank 26.

In FIG. 1, steel open top cuttings box 62 is provided adjacent to mud pit 38. Chute 64 communicates shaker 50 with cuttings box 62. Mud is delivered from shaker 50 into mud pit 38. Separated cuttings are delivered by chute 64 into cuttings box 62. Cuttings delivered to cuttings box 62 are typically removed by a track-hoe or by other means.

Continuing with the present example, first flow line valve 70 is provided on flow line 12 downstream of trip tank 16 and upstream of mud gas return leg 25. Second flow line valve 72 is provided on flow line 12 downstream of mud gas return leg 25 and upstream of shaker line 52. Third flow line valve 74 is provided on flow line 12 downstream from shaker line 52 and upstream of LCM recovery tank 26. An igniter 80, such as a flare stack, may be provided to receive gas from mud gas separator 20 through mud gas vent line 23, which may be regulated by mud gas vent line valve 24.

In use, the LCM recovery system 10 of the invention receives mud, cuttings, and LCM from wellbore 14 through flow line 12 into inlet chamber 28 of LCM recovery tank 26. The adjustable baffle 32 is height adjusted to a level suitable to accommodate a flow rate through flow line 12 to allow a desired amount of mud, cuttings and LCM to flow over adjustable baffle 32 from inlet chamber 28 into recovery chamber 30 of LCM recovery tank 26. Alternatively, baffle 32 may be fixed rather than adjustable. Further, one or more baffles 32 may be used. Mud, cuttings, and LCM remaining in inlet chamber 28 can be agitated with agitator 36 (FIGS. 1,2, 7-10) to aid in pushing relatively less dense LCM over baffle 32. Relatively heavier cuttings tend to remain in inlet chamber 28 rather than passing over baffle 32. Cuttings auger 34 (FIG. 2) may be provided in inlet chamber 28 to aid in removal of cuttings that settle within inlet chamber 28. Other contemplated or proven devices include fluid jets 82, that receive cleaning fluid from charging fluid lines 83, angled tanks, or the use of multiple suctions, which are and have been used but nonetheless are not required for successful use of the LCM recovery tank may be used to aid in the removal of cuttings that settle away from the cutting suction(s), e.g., intake pipe 63, within the inlet chamber 28. Alternatively, cuttings may be removed from inlet chamber 28 with a track-hoe for secondary removal during connections.

Mud and LCM flow from recovery chamber 30 to mud pit 38 through LCM and fluid line 40. The mud and cuttings flow from inlet chamber 28 to shaker 50 through cuttings line 60. Shaker 50 then separates mud and cuttings wherein the mud drops into mud pit 38 and cuttings are delivered to cuttings box 62 via chute 64.

In addition to receiving mud, cuttings, and LCM directly from wellbore 14, LCM recovery tank 26 may recover mud, cuttings, and LCM through flow line 12 from mud gas separator 20 through mud gas return leg 25. Mud gas separator 20 may be provided to receive mud, cuttings, and LCM through choke line 22. Separated gas is then delivered through flare line 23 to igniter 80 for disposal. Remaining mud, cuttings, and LCM are delivered from mud gas separator 20 through mud gas return leg 25. In one embodiment, mud gas return leg 25 communicates with flow line 12 upstream of second flow line valve 72, as shown in FIG. 1. Flow through mud gas return leg 25 is controlled by return leg valve 27. In other embodiments, mud gas return leg 25 may communicate directly with shakers 50 and/or with LCM recovery tank 26 for delivery of mud, cuttings, and LCM to inlet chamber 28 of LCM recovery tank 26. * * * Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed:

1. A lost circulation materials (LCM) recovery system comprising:

a flow line delivering mud, cuttings and LCM material from a wellbore;

a recovery tank having an inlet cuttings chamber and a recovery chamber, said inlet cuttings chamber receiving said mud, said cuttings and said LCM directly from said flow line;

a height adjustable baffle in said recovery tank separating said recovery tank into said inlet cuttings chamber and said recovery chamber wherein said height of said baffle is adjusted to control travel of LCM and mud to said recovery chamber; said baffle prevents flow between said chambers except over the upper edge thereof;

a mud pit;

an LCM and fluid line communicating said LCM and said mud from said recovery chamber directly to said mud pit;

a shaker delivering said mud recovered off said cuttings into said mud pit;

a cuttings line communicating said inlet cuttings chamber with said shaker; and a cuttings box in communication with said shaker for receiving said cuttings from said shaker.

2. The system according to claim 1 further comprising:

a trip tank in selective communication with said flow line; and a trip tank valve for opening or closing a pathway from said flow line to said trip tank.

3. The system according to claim 1 further comprising:

a mud gas separator;

a choke line extending from said wellbore to said mud gas separator;

a mud gas flow line vent line in communication with said flow line and with said mud gas separator;

a mud gas flow line vent line valve for selectively permitting flow in said mud gas flow line vent line;

a mud gas return leg line communicating said mud gas separator with said flow line; and a return leg valve for selectively permitting flow in said mud gas return leg line for selectively permitting flow to said flow line.

4. The system according to claim 1 further comprising:

a secondary removal device in said inlet cuttings chamber for aiding removal of said cuttings from said inlet chamber.

5. The system according to claim 4 wherein:

said secondary removal device is selected from a group consisting of a cuttings auger, a fluid jet, an angled tank, or an additional cuttings removal aid or suction device.

6. The system according to claim 1 further comprising:

an agitator in said inlet cuttings chamber, said agitator to aid in pushing less dense LCM over said baffle instead of collecting in said inlet cuttings chamber.

7. The system according to claim 6 wherein:

said agitator is driven by an electric motor.

8. The system according to claim 1 further comprising:

a shaker line communicating said shaker with said flow line; and a shaker valve for selectively permitting flow between said flow line and said shaker.

9. A method for recovery of lost circulation materials (LCM) in a drilling operation comprising the steps of:

delivering mud, cuttings, and LCM from a wellbore through a flow line directly to an inlet cuttings chamber of a recovery tank;

flowing said mud and said LCM over a height adjustable baffle or weir that separates a recovery chamber from said inlet cuttings chamber of said recovery tank;

adjusting said height of said baffle in response to rate of flow through said flow line to control travel of LCM and mud to said recovery chamber;

flowing said mud and said LCM from said recovery chamber directly to a mud pit through an LCM and fluid line;

flowing said mud and said cuttings from said inlet cuttings chamber to a shaker;

separating said mud and said cuttings, wherein said mud drops into said mud pit and said cuttings are delivered to a cuttings box; and delivering said mud and said LCM from said mud pit to said wellbore.

10. The method of recovery according to claim 9 wherein:

said step of delivering said mud, said cuttings, and said LCM comprises flowing said mud, said cuttings, and said LCM from a mud gas separator through said flow line into said inlet cuttings chamber of said recovery tank or to said shaker; and flowing gas from said mud gas separator to an igniter.

11. The method according to claim 9 further comprising the step of:

agitating said mud and said cuttings in said inlet cuttings chamber to aid in pushing said LCM over said baffle instead of collecting in said inlet chamber.

12. The method according to claim 9 further comprising the step of:

aiding removal of said cuttings from said inlet cuttings chamber with a secondary removal device.

13. The method according to claim 12 wherein:

said secondary removal device is selected from a group consisting of a cuttings auger, a fluid jet, an angled tank, or an additional cuttings removal aid or suction device.

* * * * *